US006988874B2

(12) United States Patent
Spargo

(10) Patent No.: US 6,988,874 B2
(45) Date of Patent: Jan. 24, 2006

(54) TILE FLOOD PUMP

(76) Inventor: Rick D. Spargo, 2118 S. Broad St., Hoxie, AR (US) 72433

( * ) Notice: Subject to any disclaimer, the term of this patent is extended or adjusted under 35 U.S.C. 154(b) by 290 days.

(21) Appl. No.: 10/460,094

(22) Filed: Jun. 12, 2003

(65) Prior Publication Data

US 2003/0231966 A1 Dec. 18, 2003

Related U.S. Application Data

(60) Provisional application No. 60/389,151, filed on Jun. 17, 2002.

(51) Int. Cl.
*F04B 53/00* (2006.01)

(52) U.S. Cl. ..... 417/234; 417/231; 417/313; 417/423.9

(58) Field of Classification Search ..... 417/231, 417/234, 300, 313, 423.9
See application file for complete search history.

(56) References Cited

U.S. PATENT DOCUMENTS

| | | | | | |
|---|---|---|---|---|---|
| 1,206,790 | A | * | 12/1916 | Andrews | 417/234 |
| 2,664,052 | A | * | 12/1953 | Schmidt | 417/234 |
| 2,698,583 | A | * | 1/1955 | House et al. | 415/121.2 |
| 2,744,465 | A | * | 5/1956 | Springer | 417/234 |
| 2,799,229 | A | * | 7/1957 | Ogles et al. | 415/121.3 |
| 2,962,866 | A | | 12/1960 | Muehlfeld | 61/10 |
| 3,008,422 | A | * | 11/1961 | Crisafulli | 417/234 |
| 3,170,646 | A | * | 2/1965 | Springer | 241/276 |
| 3,490,380 | A | * | 1/1970 | Beckett | 417/234 |
| 3,832,093 | A | | 8/1974 | Shirek et al. | 417/231 |
| 3,905,725 | A | * | 9/1975 | Johnson | 417/231 |
| 3,910,722 | A | * | 10/1975 | Hochmuth | 417/34 |
| 4,070,135 | A | * | 1/1978 | Eller | 417/234 |
| 4,175,916 | A | | 11/1979 | Crisafulli | 417/231 |
| 4,594,006 | A | * | 6/1986 | Depeault | 366/266 |
| 5,364,233 | A | | 11/1994 | Benoit | 417/231 |
| 5,618,166 | A | * | 4/1997 | Legett et al. | 417/313 |
| 5,624,241 | A | * | 4/1997 | Nesseth | 417/234 |
| 5,860,792 | A | * | 1/1999 | Marks | 417/366 |
| 6,401,829 | B1 | * | 6/2002 | Newton | 169/24 |

(Continued)

*Primary Examiner*—William H. Rodriguez
(74) *Attorney, Agent, or Firm*—John M. Harrison

(57) ABSTRACT

A tile flood pump for attachment to a tile or drain pipe and pumping water from a field through the tile or drain pipe to a drainage ditch or canal. The tile flood pump is characterized by a cylindrical pump housing fitted with a flange for removably bolting to the existing tile or pump embedded in a levee or dike separating the field from the drainage canal and a cylindrical impeller housing enclosing one or more shaft-mounted rotating impellers, the impeller housing extending into the pump housing in angular relationship for pumping water from the field through the pump housing and the tile and into the ditch. A pump housing flapper valve on the intake end of the pump housing can be selectively open or closed by a control rod mechanism to facilitate a flow of water by direct drainage through the pump housing and the tile into the ditch, or for pumping water through the impeller housing, the pump housing and the tile when the water in the ditch is at a higher level than the water in the field. A shaft housing also extends into the pump housing in alignment with the impeller housing for enclosing a drive shaft that mounts the impeller(s) and connects to an external drive system. The tile flood pump can be typically operated by means of a power take-off system on a tractor or by a diesel, gasoline powered or electric motor.

20 Claims, 6 Drawing Sheets

U.S. PATENT DOCUMENTS 6,447,260 B1 * 9/2002 Eller et al. ..... 417/234
6,520,750 B2 * 2/2003 Eller et al. ..... 417/234
2002/0187054 A1 * 12/2002 Eller et al. ..... 417/234
2005/0053477 A1 * 3/2005 Kunz et al. ..... 417/234

* cited by examiner

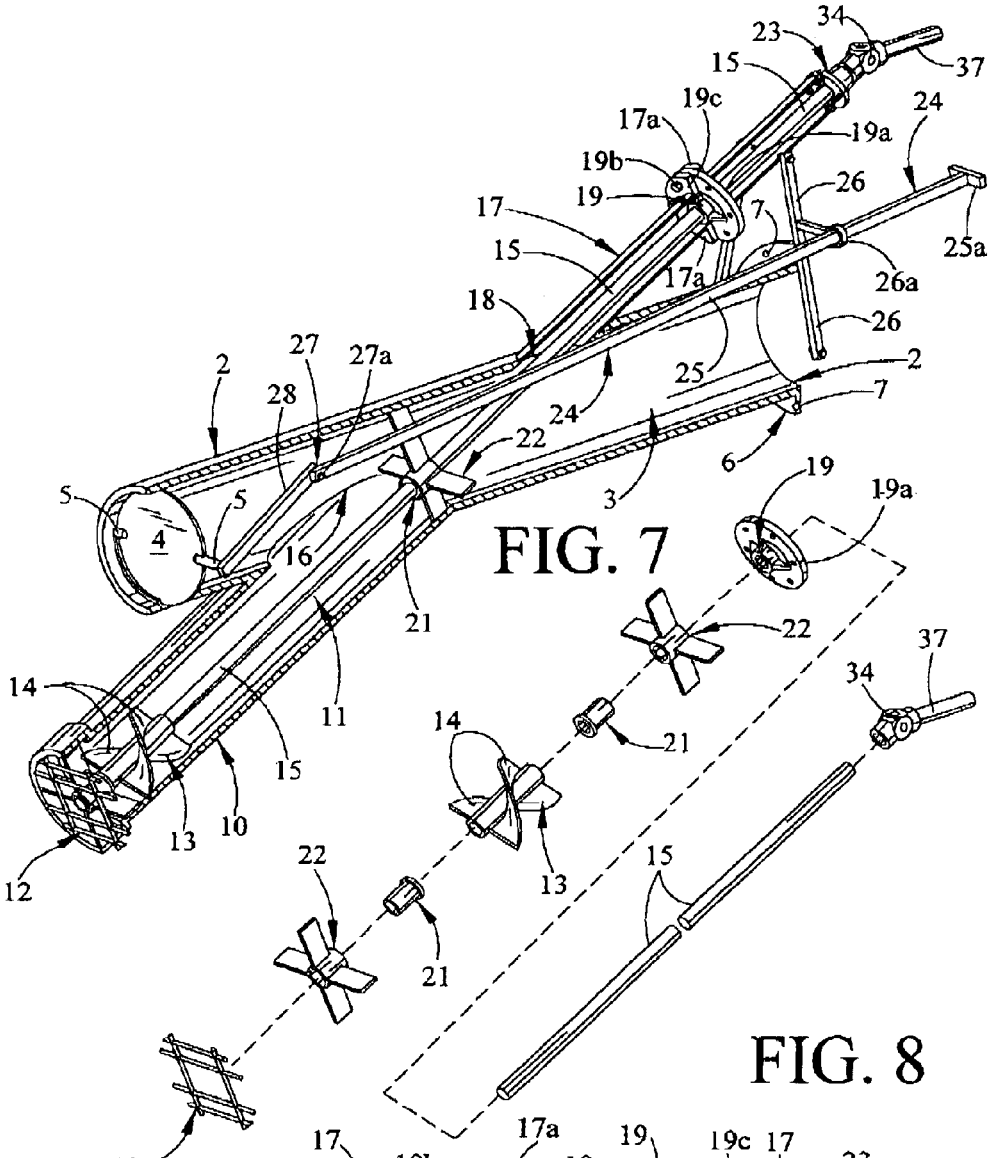
FIG. 7
FIG. 8
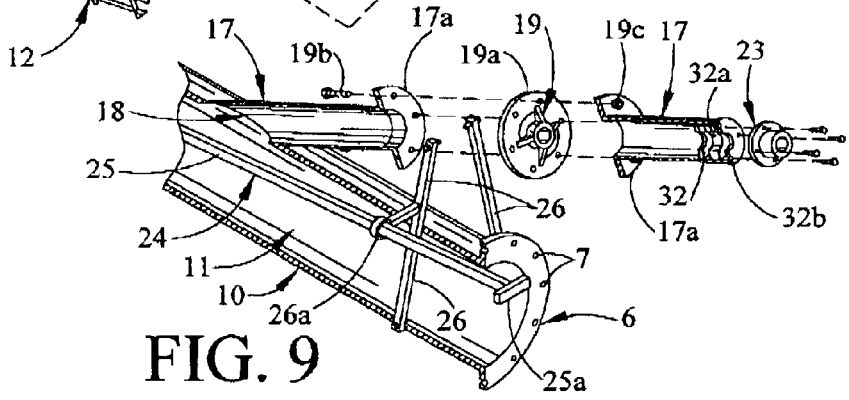
FIG. 9

TILE FLOOD PUMP

CROSS-REFERENCE TO RELATED APPLICATIONS

This application claims the benefit of and incorporates by reference prior filed U.S. Provisional Application Ser. No. 60/389,151, filed Jun. 17, 2002 now abandoned.

BACKGROUND OF THE INVENTION

SUMMARY OF THE INVENTION

This invention relates to pumping devices for pumping water from flooded fields to drainage ditches, catch basins and canals. More particularly, the invention relates to a portable or fixed tile flood pump that can be quickly and efficiently moved, installed and operated in a selected location by the power take-off from a tractor or directly from a diesel, gasoline-powered or electric motor. The pump includes a horizontal pump housing, flanged or otherwise attached to an existing tile or drain pipe extending through a dam, levee or dike from the field to the drainage ditch. An impeller housing joins the pump housing in angular relationship and is immersed in the water covering the field and the impeller housing encloses one or more impellers fixed to an impeller shaft or shafts to pump the water from the field through the impeller housing and the pump housing and through the existing tile or drain pipe, into the drainage ditch. A shaft housing joins the pump housing in angular relationship and is disposed in linear alignment with the impeller housing and typically includes an upper load bearing and an upper marine bearing or bushing for stabilizing one end of the rotating shaft or shafts, the other end of which shaft or shafts are attached to the impeller or impellers and extends through a lower marine bearing and a lower load bearing or bushing located in the impeller housing, for stabilizing the opposite end of the shaft(s). The shaft or shafts are rotated by a tractor power take-off or other driving mechanism to rotate the impeller or impellers, each of which typically consists of two or more flights or screws, fixedly mounted on the shaft or shafts, for pumping the water from the field to the drainage ditch.

BRIEF DESCRIPTION OF THE DRAWINGS

The invention will be better understood by reference to the accompanying drawings, wherein:

FIG. 7 is a sectional view of the respective housings of the tile flood pump illustrated in FIGS. 1–4, more particularly illustrating a preferred end-shaft location of the impeller;

FIG. 8 is an exploded view of the single impeller shaft and impeller assembly illustrated in FIGS. 1–7, more particularly illustrating an alternative center-shaft location of the impeller;

FIG. 9 is a sectional view of the drive end of the shaft housing of the file flood pump illustrated in FIG. 7, illustrating the drive bearing, upper flange bearing and the interior of the shaft housing;

DESCRIPTION OF THE PREFERRED EMBODIMENTS

Figure 1:
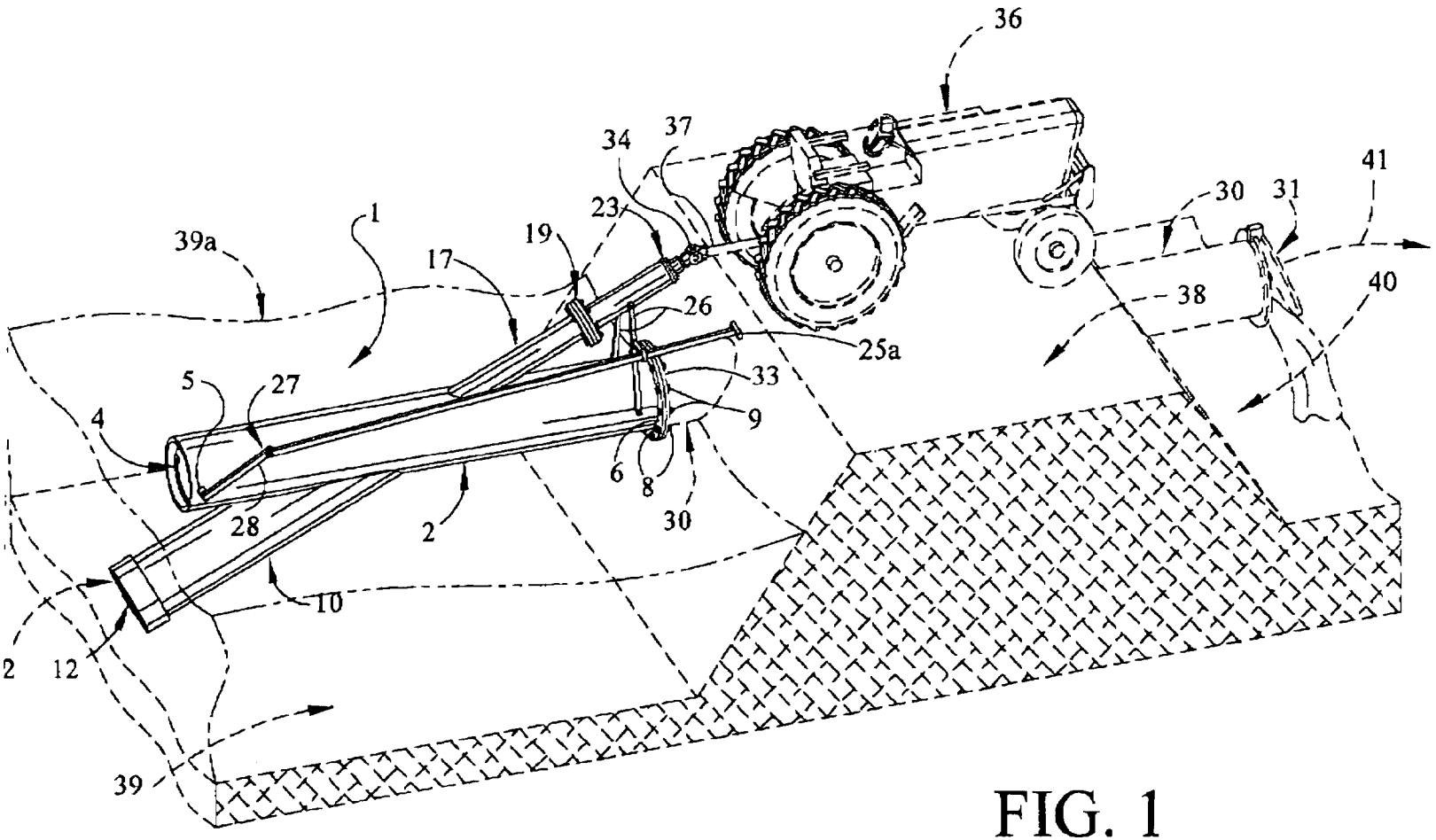
FIG. 1 is a perspective view of a preferred embodiment and typical installation of the tile flood pump, illustrating an existing permanent tile or drainage pipe buried in a levee or dike separating a flooded field from a drainage ditch, with the tile flood pump of this invention disposed on the field side of the levee, flanged to the tile or drainage pipe and driven by the power take-off shaft of a tractor.

Referring initially to FIG. 1 of the drawings a preferred embodiment of the tile flood pump of this invention is generally illustrated in a preferred embodiment as reference numeral 1. The tile flood pump 1 is illustrated in functional position attached to the field end of an existing tile or drain pipe 30, embedded substantially horizontally in a levee or dike 38, with the discharge end of the tile 30 extending over a drainage ditch 40 and typically fitted with a tile flapper valve 31, for preventing water from backing up from the drainage ditch 40, through the tile 30 and back into the field 39. The tile flood pump 1 is oriented such that the cylindrical pump housing 2 is substantially horizontally disposed and is typically flanged to the tile flange 33 on the flanged intake end 30*a* of the tile 30, at the field 39. An impeller housing 10 extends in angular relationship downwardly and outwardly of the pump housing 2 and terminates in an intake grid 12, which serves as a water inflow or intake 42, as indicated by the arrow in FIG. 1. Accordingly, water is typically pumped from the field 39 as indicated by the water inflow or intake arrow 42, through the intake grid 12, into the impeller housing 10 and through the pump housing 2 from the discharge end of the tile 30 at the flapper valve 31, into the drainage ditch 40, as further illustrated in FIG. 1. In a typical embodiment of the invention a tractor 36, fitted with a power take-off 37, is oriented on the levee 38 such that the power take-off 37 can be connected to the impeller shaft 15, illustrated in FIGS. 5 and 7, of the tile flood pump 1, through a universal joint 34, to operate the power take-off 37, the impeller shaft 15 and the internal impeller 13 and pump water from the field 39 to the drainage ditch 40, as hereinafter further described. The tile flood pump 1 is typically portable and can be transported to the field 39 on a trailer 35, pulled by the tractor 36, as illustrated in FIG. 6.

Figure 2:
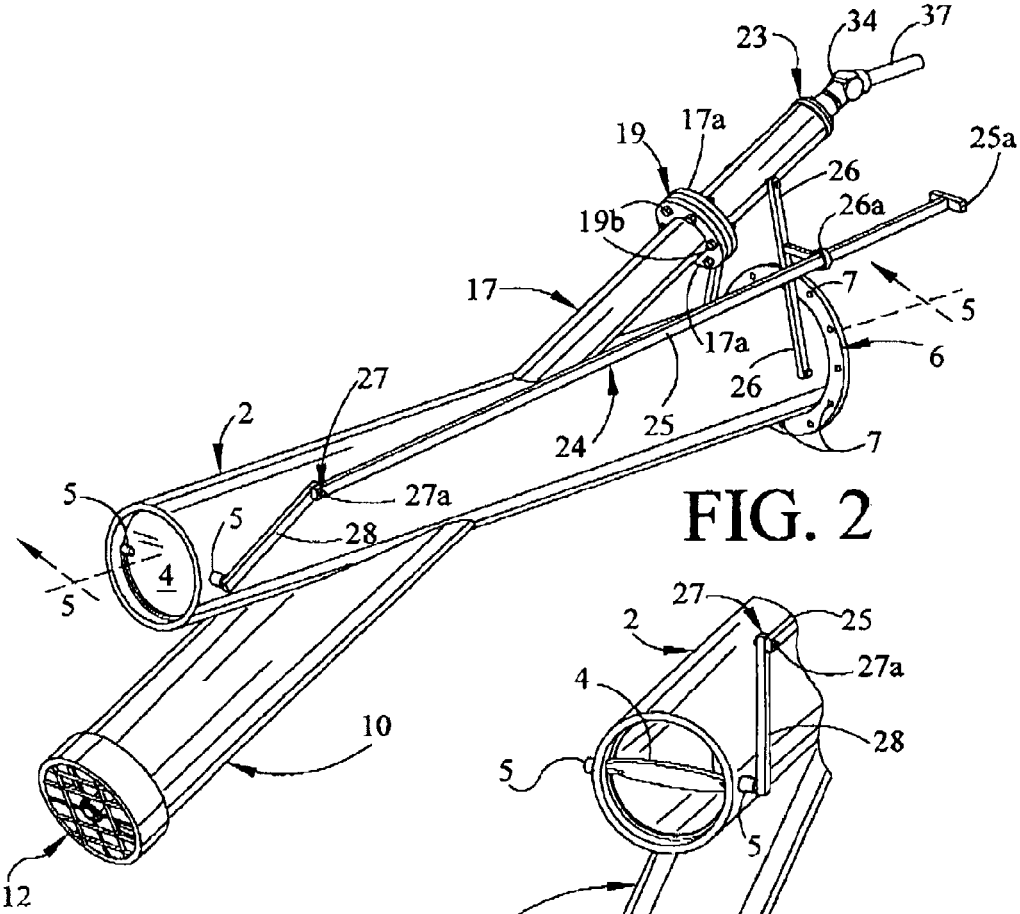
FIG. 2 is a front perspective view of the tile flood pump illustrated in FIG. 1, more particularly illustrating the pump housing, shaft housing and corresponding impeller housing.
Figure 3:
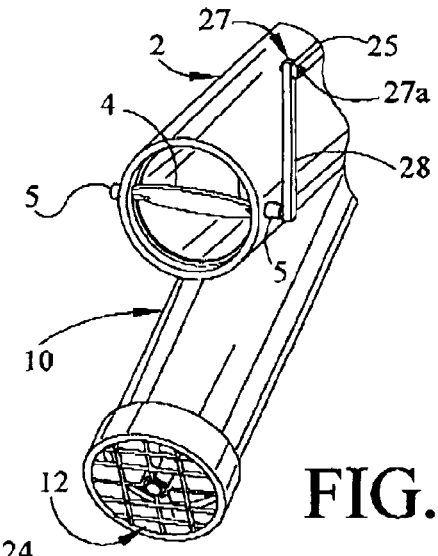
FIG. 3 is a perspective view, partially in section, of the tile flood pump illustrated in FIGS. 1 and 2, illustrating the intake end of the pump housing and the flapper valve therein, along with the intake end of the impeller housing.
Figure 4:
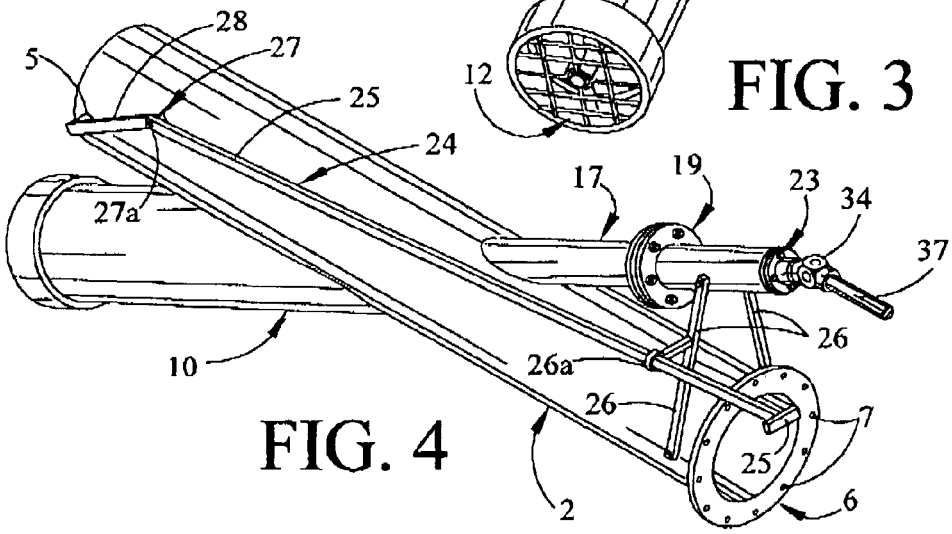
FIG. 4 is a rear perspective view of the pump housing, shaft housing and impeller housing of the tile flood pump, illustrated in FIG. 2, more particularly illustrating a typical flapper valve control and the power drive coupling to the impeller shaft in the shaft housing.

Referring now to FIGS. 2–5 of the drawings, the tile flood pump 1 illustrated in FIGS. 1 and 2 includes a cylindrical pump housing 2 of selected length and diameter, having a pump housing bore 3 (FIG. 5) of corresponding size and a pump housing flapper valve 4, pivoted to the intake end of the pump housing 2 by means of a flapper valve pin 5 (FIGS. 2 and 4) for controlling the flow of water through the pump housing 2. This flow control is effected by means of a flapper valve control 24 that includes a flapper valve control rod 25, slidably extending through a brace ring 26*a,* mounted to a corresponding control handle brace 26, which is attached to a shaft housing 17 and is connected at the extending end to a flapper valve connecting rod 28 by means of a control handle pivot 27. The flapper valve connecting rod 28 is, in turn, attached to the flapper valve pin 5 of the pump housing flapper valve 4, such that the flapper valve control rod 25 can be grasped at the control rod grip 25*a* and pulled to open the pump housing flapper valve 4. In like manner, the flapper valve control rod 25 can be pushed to close the pump housing flapper valve 4 and prevent water from flowing through the pump housing 2 and the tile 30, from the field 39 to the drainage ditch 40.

Figures 5, 6:
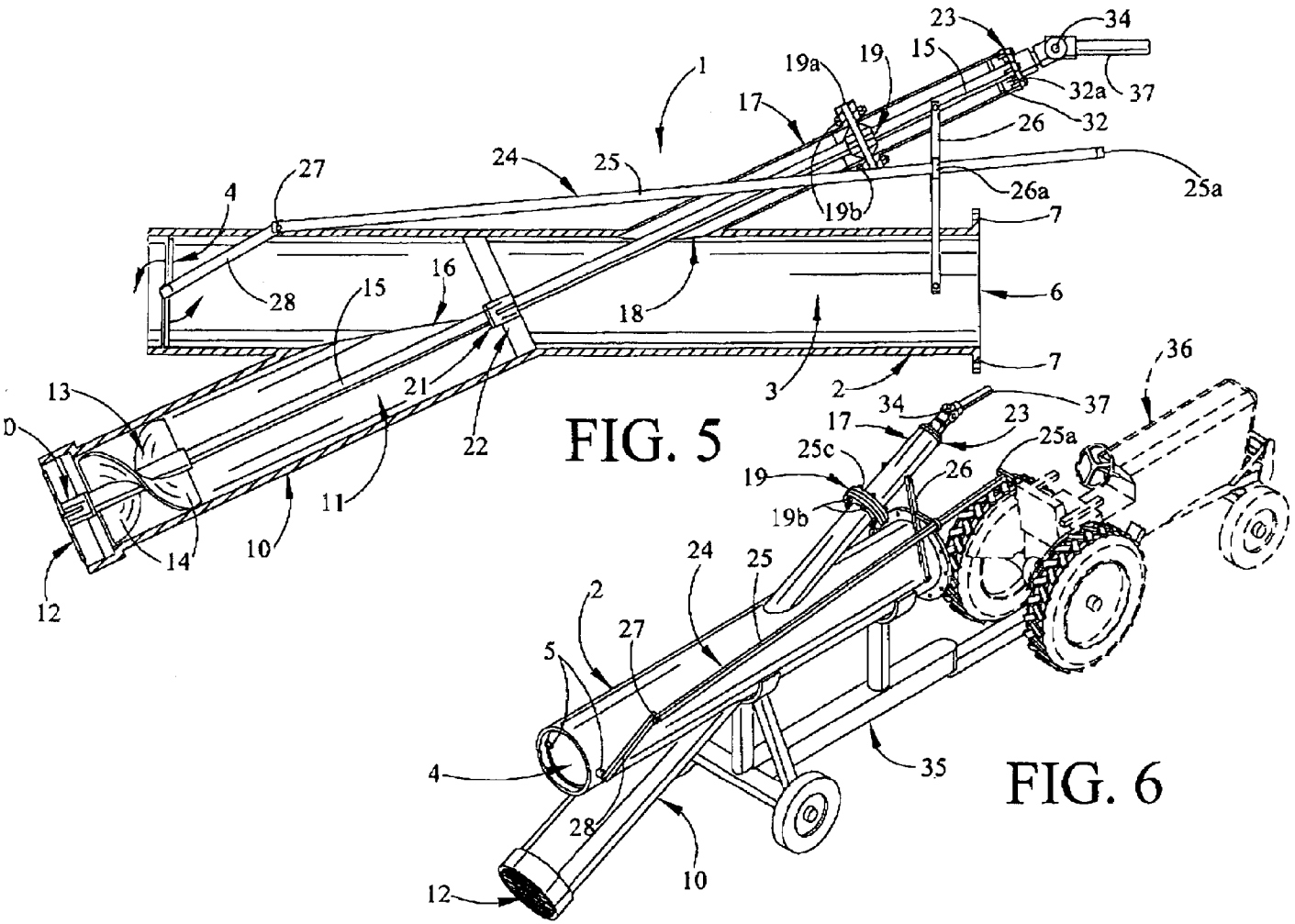
FIG. 5 is a sectional view taken along line 5—5 of the tile flood pump illustrated in FIG. 2, more particularly illustrating first preferred single impeller shaft and impeller pump components.
FIG. 6 is a perspective view of a portable tile flood pump illustrated in FIGS. 1–5, located on a trailer pulled by a tractor for transportation of the tile flood pump.
Figure 10:
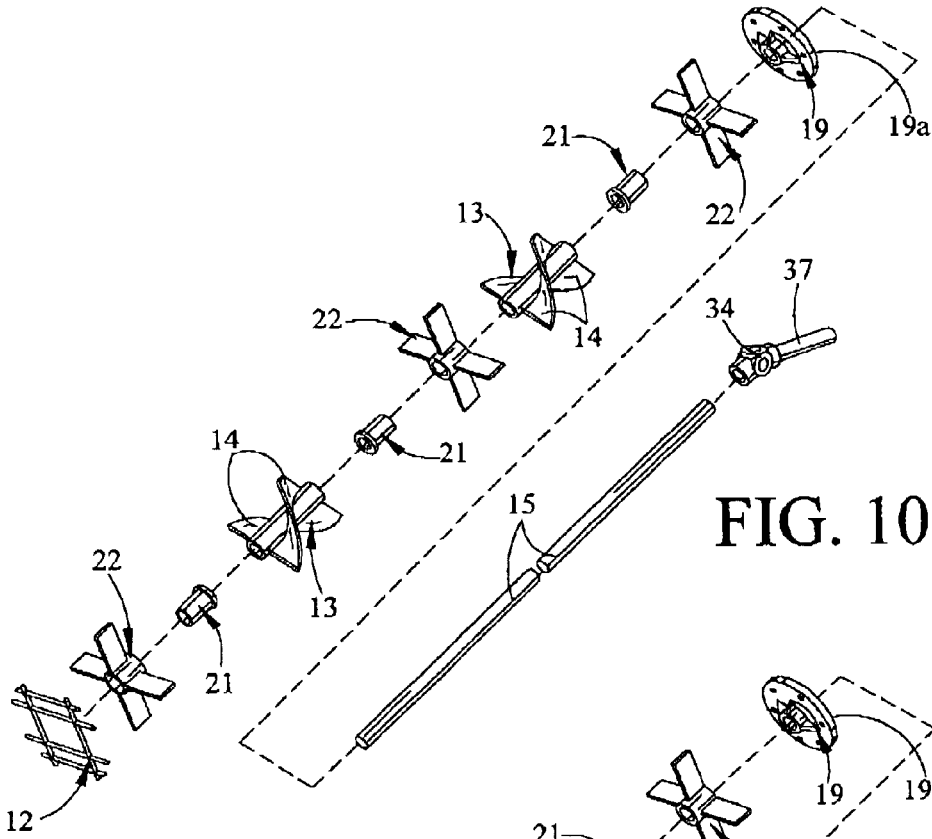
FIG. 10 is an exploded view of a spaced-apart, single-shaft, dual impeller configuration of the file flood pump illustrated in FIG. 1.
Figure 11:
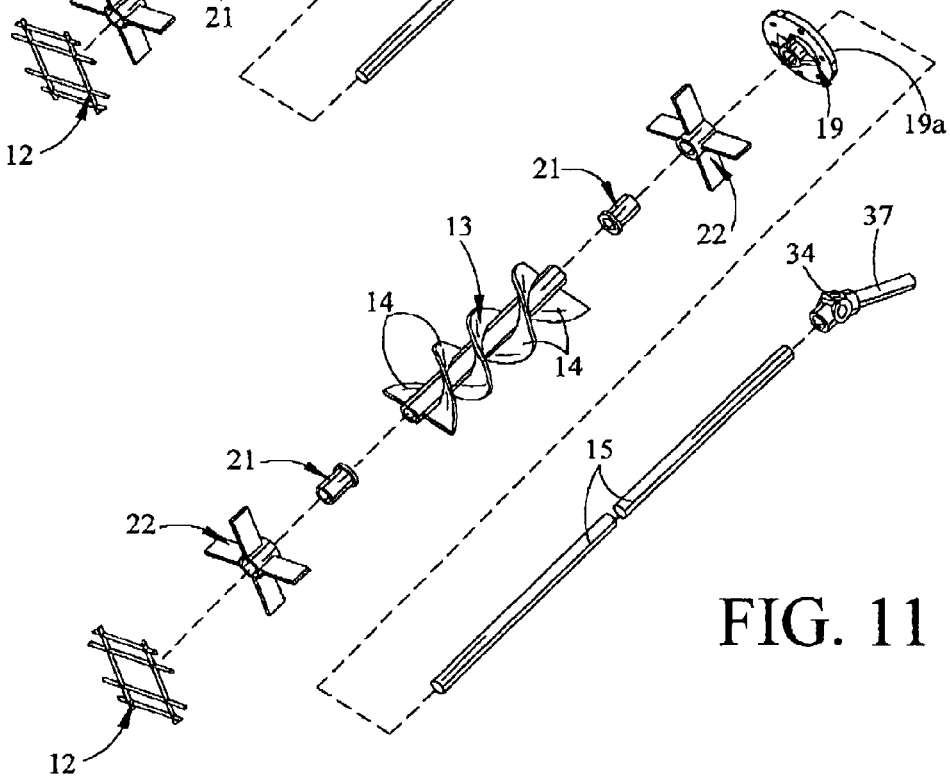
FIG. 11 is an exploded view of an alternative dual impeller configuration of the tile flood pump illustrated in FIG. 1.

As further illustrated in FIGS. 2, 5 and 9 a cylindrical shaft housing 17 joins the pump housing 2 in angular relationship at a shaft housing opening 18 (FIG. 5) and the shaft housing 17 is aligned with the impeller housing 10, which joins the pump housing 2 at the impeller housing discharge opening 16 (FIG. 5). Accordingly, it will be appreciated from a consideration of FIGS. 5 and 7 that the shaft housing 17 and the impeller housing 10 are aligned with each other in order to accommodate the impeller shaft 15, one end of which extends through an upper flange bearing 19, mounted in a bearing flange 19*a,* which is secured to facing shaft housing flanges 17*a* (FIG. 9) by bearing flange bolts 19*b* and nuts 19*c,* near one end of the shaft housing 17. The impeller shaft 15 extends further into an upper load bearing 23, mounted on the shaft housing 17 by means of bearing mount bolts 23*a,* and through a spacer plate 32, to the universal joint 34. The impeller shaft 34 projects downwardly through the shaft housing 17 and the pump housing 2, where the extending end terminates in the impeller housing 10 in a lower load bearing 20 (FIG. 5). An impeller 13 is rigidly attached by any convenient technique to the impeller shaft 15 in the impeller housing bore 11 near the intake end of the impeller housing 10 at the intake grid 12, and typically includes one or more impeller flights 14, which rotate with the impeller shaft 15 and operate to pump water through the intake grid 12, located on the extending end of the impeller housing 10, as it is immersed in the flooded field 39. Water is thus pumped through the intake grid 12, the impeller housing 10, the pump housing 2 and through the tile 30, into the drainage ditch 40, by rotation of the impeller shaft 15 and the impeller 13, as illustrated in FIG. 1. In a preferred embodiment, the impeller shaft 15 is further stabilized inside the shaft housing 17 by means of a marine bearing 21, mounted inside the pump housing 2 by means of marine bearing mounts 22, deployed as further illustrated in FIGS. 5 and 7. Furthermore, the control handle braces 26 extend from fixed attachment to the shaft housing 17 to welded or otherwise fixed attachment to the pump housing 2, for securing the shaft housing 17 to the pump housing 2 in alignment with the impeller housing 10 and stabilizing the flapper valve control rod 25, by means of the brace ring 26*a*. FIG. 8 details an alternative center-shaft mounted impeller 13, stabilized by a pair of marine bearings 21, while FIGS. 10 and 11 illustrate other variations in number and mounting locations of the impeller 13. As further illustrated in FIGS. 5 and 9, the spacer plate 32 is spaced from the upper load bearing 23 in the upper end of the shaft housing 17 to define a weep space 32*a* in the spacer plate 32. A weep hole or slot 32*b* in the shaft housing 17 allows water forced upwardly into the shaft housing 17 from the pump housing 2, to seep along the impeller shaft 15, past the spacer plate 32 and from the shaft housing 17, to indicate the pumping efficiency of the tile flood pump 1.

Referring again to FIGS. 1, 5 and 7 of the drawings, in a preferred embodiment of the invention the pump housing flapper valve 4 is pivotally secured to the intake end of the pump housing 2 by means of the flapper valve pin 5, that extends through the end of the pump housing 2 across a diameter thereof, to facilitate opening and closing of the pump housing flapper valve 4 responsive to slidable manipulation of the flapper valve control 24, as hereinafter further described. Furthermore, the pump housing 2 is most preferably fitted with a pump housing flange 6, having pump housing flange openings 7, for securing the pump housing 2 to the tile flange 33 on the flanged intake end 30*a* of the tile 30, as illustrated in FIG. 1. Flange bolts 8 illustrated in FIG. 1 serve to removably connect the pump housing flange 6 of the pump housing 2 to the tile flange 33, on the flanged intake end 30*a* tile flange of the tile 30.

In operation, and referring again to the drawings, the tile flood pump 1 is typically portable and can be transported by means of a tractor and trailer 35 (FIG. 6) or a pickup truck or other vehicle to and from a specific location (FIG. 6), where a tile 30 is embedded in a levee 38 for draining a field 39 (FIG. 1) during high water or flood conditions. Accordingly, the tile flood pump 1 can be transported to the desired location, lowered into the flooded field 39 and secured to the flanged intake end 30*a* of the existing tile 30, by connecting the tile flange 33 of the tile 30 to the corresponding pump housing flange 6 of the pump housing 2, using the flange bolts 8 and flange bolt nuts 9, as illustrated in FIG. 1. When the tile flood pump 1 is in the position illustrated in FIG. 1, connected to the tile 30, the pump housing flapper valve 4 illustrated in FIGS. 1, 5 and 7 can be opened by grasping the control rod grip 25*a* of the flapper valve control rod 25 and pulling the flapper valve control rod 25, which action exerts pressure on the flapper rod connecting rod 28 at the control handle pivot pin 27*a* and causes the pump housing flapper valve 4 to pivot into the open position on the flapper valve pin 5, as further illustrated in FIG. 3. The tractor 36 or alternative power supply unit can then be operated to rotate the power take-off 37, turn the impeller shaft 15 and the impeller or impellers 13 inside the impeller housing 10, and cause water to flow through the intake grid 12, as indicated by the water inflow arrow 42 illustrated in FIG. 1. Accordingly, the water is caused to flow from the field 39, through the impeller housing 10 and the pump housing 2 by rotation of the impeller flights 14 on the impeller 13. The water is further caused to flow from the pump housing 2 through the tile 30 and from the tile 30 at the tile flapper valve 31, as indicated by the water discharge 41, into the drainage ditch 40, illustrated in FIG. 1. This pumping action forces the tile flapper valve 31 to pivot into the open configuration and pumping may be continued until the water level in the field 39 is sufficiently low to minimize the damage to crops or other adverse conditions resulting from high water in the field 39, at which time the power to the power take-off 37 is terminated. The operation of the tile flood pump 1 is then stopped and the control rod grip 25*a* is grasped to push the flapper valve control rod 25 toward the field 39, along with the flapper valve connecting rod 28 and pivot the pump housing flapper valve 4 on the flapper valve pin 5, to close the pump housing flapper valve 4, if reverse gravity drain of water from the drainage ditch 40, through the pump housing 2 and the tile 30, back into the field 39 is undesirable. This action thus prevents water from flowing through the pump housing 2 by gravity and into or from the tile 30 into or from the drainage ditch 40. Alternatively, if additional gravity drainage from the field 39 to the drainage ditch 40 is desired without pumping action, and if the water level in field 39 is above that in the drainage ditch 40, the pump housing flapper valve 4 may be pivoted to the open position as described above, to facilitate gravity drainage of the water into the drainage ditch 40, without the necessity of operating the tile flood pump 1. However, under circumstances where the water in the drainage ditch 40 is higher than the water in the field 39 and water still must be pumped from the field 39 into the drainage ditch 40, the tile flood pump 1 can be operated as described above to achieve this result, although the discharge end of the tile 30 may be immersed and submerged in the water of the drainage ditch 40.

Figure 12:
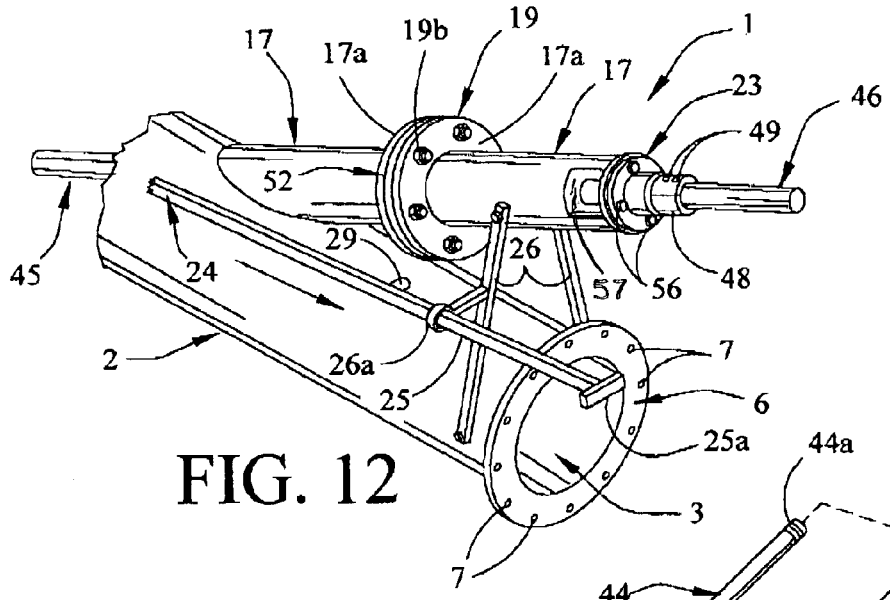
FIG. 12 is a perspective view partially in section, of the tile flood pump having an alternate drive end design.
Figure 13:
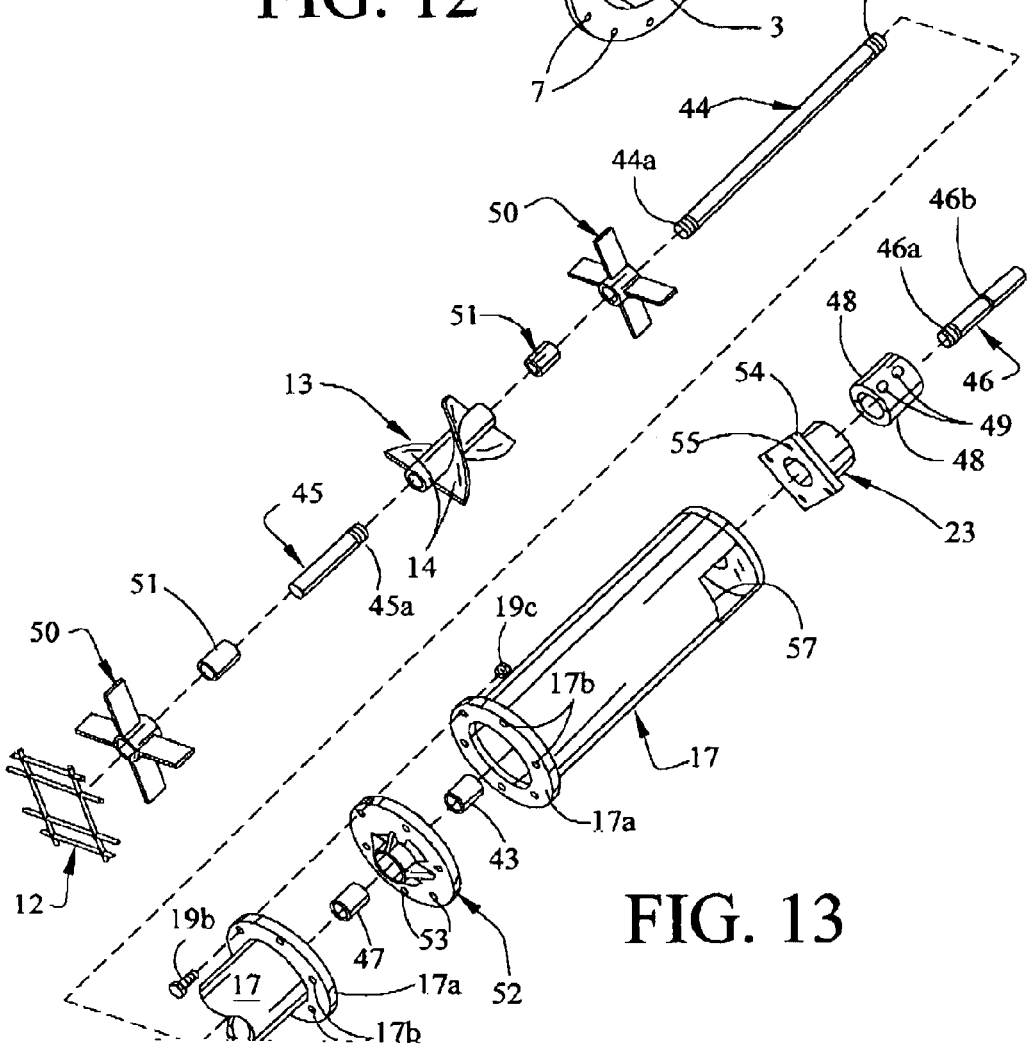
FIG. 13 is a perspective exploded view of the tile flood pump illustrated in FIG. 12.

In another preferred embodiment of the invention the tile flood pump 1 is characterized as illustrated in FIGS. 12 and 13 of the drawings, wherein the shaft housing 17 includes a corresponding bushing flange 52, having bushing flange openings 53 aligned with the corresponding bearing flange openings 17*b* in the mating shaft housing flanges 17*a*. Suitable mounting bolts such as the bearing flange bolts 19*b* and bearing flange nuts 19*c* are used to secure the bushing flange 52 tightly against the shaft housing flanges 17*a* of the shaft housing 17, in the same manner as illustrated in FIG. 1 of the drawings in joining the pump housing 2 to the tile 30. The bushing flange 52 is fitted with a bushing 47, which may be constructed of any suitable material, but is typically shaped from polyethylene plastic. The bushing flange 52 receives a top impeller shaft 44, that extends through the shaft housing 17 and is threadably seated in the impeller 13, as further illustrated in FIG. 13. The top end of the top impeller shaft 44 is provided with top impeller shaft threads 44*a* that threadably seat in a threaded union 43. In like manner, the bottom end of a drive shaft 46 projects into the top end of the shaft housing 17 and is fitted with drive shaft threads 46*a,* that also seat in the threaded union 43. Accordingly, it will be appreciated from a consideration of FIG. 13 of the drawings that the drive shaft 46 is connected to the top impeller shaft 44 by means of the threaded union 43 and the impeller 13 is threadably seated on the bottom end of the top impeller shaft 44, for rotation responsive to driving operation of the drive shaft 46, as hereinafter further described. A bottom impeller shaft 45 is fitted with bottom impeller shaft threads 45*a* that are threaded into the bottom end of the impeller 13 and the bottom impeller shaft 45 extends through an impeller shaft bushing mount 50, fitted with a bottom mount bushing 51. Accordingly, the bottom impeller shaft 45 is journalled for rotation in the impeller shaft bushing mount 50 in the bottom mount bushing 51. Similarly, as further illustrated in FIG. 13, the top impeller shaft 44 extends through a second impeller shaft bushing mount 50, fitted with a corresponding bottom mount bushing 51 for journalling the top impeller shaft 44 for rotation in the impeller shaft bushing mount 50 and corresponding bottom mount bushing 51. It will be appreciated from further consideration of FIG. 13 of the drawings that the two, spaced-apart propeller shaft bushing mounts 50, each fitted with a bottom mount bushing 51, serve to stabilize rotation of the drive shaft 46, the top impeller shaft 44 and the bottom impeller shaft 45 in the shaft housing 17 and the impeller housing 10 (FIG. 5), responsive to driving operation of the drive shaft 46.

Referring again to FIGS. 12 and 13 of the drawings, the drive shaft 46 is fitted with a drive shaft neck 46*b* for receiving a pair of load couplers 48, which load couplers 48 are mounted on the drive shaft 46 at the drive shaft neck 46*b* by means of load coupler bolts 49. Accordingly, the load couplers 48, when mounted on the drive shaft 46 as indicated above, prevent the drive shaft 46 from moving linearly under driving loads and water pressure exerted against the impeller 13, to further stabilize the drive shaft 46, the top impeller shaft 44 and the bottom impeller shaft 45, as well as the impeller 13, in the shaft housing 17 and the impeller housing 10. It will be further appreciated from a consideration of FIGS. 12 and 13 of the drawings that the upper load bearing 23 may be fitted with a coupling flange 54, that may be either square or round, and is fitted with coupling flange openings 55 (FIG. 13) for receiving coupling flange bolts 56 (FIG. 12) and corresponding nuts (not illustrated) for securing the upper load bearing 23 on the shaft housing 17, as illustrated. A bearing access opening or window 57 is also typically provided in the shaft housing 17 adjacent to the upper load bearing 23, and serves both to access the upper load bearing 23 and as a weep space, in the same manner and for the purpose heretofore described with respect to the weep space 32*a* and weep slot 32*b,* illustrated in FIGS. 5 and 9 of the drawings.

Referring again to FIGS. 1 and 12 of the drawings in a preferred embodiment of the invention the flapper valve control rod 25 of the flapper valve control 24 is fitted with a rod stop 29, to facilitate extension of the flapper valve control rod 25 in the direction of the arrow to a pre-selected degree for opening the pump housing flapper valve 4, illustrated in FIG. 1, to a desired degree. It will be further appreciated from a consideration of FIG. 12 of the drawings that the drive shaft 46 is coupled to the power take-off 37 of the tractor 36 as further illustrated in FIG. 1, using the universal joint 34 provided in the power take-off 37, as heretofore described with respect to FIGS. 1–5 of the drawings.

It will be appreciated by those skilled in the art that the tile flood pump of this invention is characterized by convenience, portability and flexibility, in that it can be quickly and easily transported to a pumping site, attached to substantially any existing tile or drain pipe at any specific location in a levee or dike which separates a flooded field from a drainage ditch and used to drain the field. Furthermore, the tile flood pump can be powered by substantially any desired means, including the power take-off from the tractor or by coupling the drive shaft of a diesel, or gasoline engine or an electric motor to the impeller shaft 15, typically at a universal joint 34, in conventional fashion. Moreover, the tile flood pump 1 can be left in place as illustrated in FIG. 1 to facilitate normal gravity drainage of water from the field 39 to the drainage ditch 40 under circumstances where the water in the field 39 is above that of the drainage ditch 40, or it can be used to pump against high water located in the drainage ditch 40, although the water level in the field 39 may be well below that of the drainage ditch 40, as described above.

While the preferred embodiments of the invention have been described above, it will be recognized and understood that various modifications may be made in the invention and the appended claims are intended to cover all such modifications which may fall within the spirit and scope of the invention. Having described my invention with the particularity set forth above, what is claimed is:

What is claimed is:

1. A pump for coupling to a pipe and pumping water from a first location through the pipe to a second location, said pump comprising a pump housing having an intake end and a connecting end adapted for coupling to the pipe; a pump housing valve provided in said pump housing for controlling a flow of water through said pump housing and the pipe; an impeller housing having a suction end extending into said pump housing intermediate the ends of said pump housing; a shaft housing extending from said pump housing intermediate the ends of said pump housing, said shaft housing positioned substantially in alignment with said impeller housing; an impeller shaft journalled for rotation in said shaft housing and said impeller housing, said impeller shaft extending through said pump housing; and at least one impeller fixed to said impeller shaft for pumping water from said first location through said impeller housing and said pump housing and through the pipe to said second location, responsive to rotation of said impeller shaft and said impeller.

2. The pump of claim 1 comprising a valve control mechanism connected to said pump housing valve for selectively opening and closing said pump housing valve.

3. The pump of claim 1 comprising an intake grid provided on said suction end of said impeller housing for screening the water flowing from said first location into said impeller housing.

4. The pump of claim 1 comprising:

(a) a valve control mechanism connected to said pump housing valve for selectively opening and closing said pump housing valve; and (b) an intake grid provided on said suction end of said impeller housing for screening the water flowing from said first location into said impeller housing.

5. The pump of claim 1 comprising a flange provided on said connecting end of said pump housing for engaging the pipe and removably connecting said pump housing to the pipe.

6. The pump of claim 5 comprising:

(a) a valve control mechanism connected to said pump housing valve for selectively opening and closing said pump housing valve; and (b) an intake grid provided on said suction end of said impeller housing for screening the water flowing from said first location into said impeller housing.

7. The pump of claim 1 wherein said impeller housing and said shaft housing extend into said pump housing in a selected angular relationship with respect to said pump housing, said impeller housing projecting downwardly from said pump housing and said shaft housing projecting upwardly from said pump housing substantially in alignment with said impeller housing, for accommodating said impeller shaft.

8. The pump of claim 7 comprising:

(a) a valve control mechanism connected to said pump housing valve for selectively opening and closing said pump housing valve;

(b) an intake grid provided on said suction end of said impeller housing for screening the water flowing from said first location into said impeller housing; and (c) a flange provided on said connecting end of said pump housing for engaging the pipe and removably connecting said pump housing to the pipe.

9. The pump of claim 2 wherein said pump housing valve comprises a flapper valve mounted on said intake end of said pump housing and wherein said valve control mechanism comprises an elongated rod having one end connected to said flapper valve, wherein said flapper valve is selectively opened and closed by manipulation of said rod.

10. The pump of claim 9 comprising:

(a) an intake grid provided on said suction end of said impeller housing for screening the water flowing from said first location into said impeller housing; and (b) a flange provided on said connecting end of said pump housing for engaging the pipe and removably connecting said pump housing to the pipe.

11. A tile flood pump for coupling to a tile pipe and pumping water from one location through the pipe to a second location, said tile flood pump comprising a pump housing having an intake end and a connecting end adapted for coupling to the tile pipe; a pump housing flapper valve provided in said intake end of said pump housing for controlling a flow of water through said pump housing and the tile pipe; an elongated rod pivotally connected to said flapper valve for selectively opening and closing said flapper valve; an impeller housing having a suction end and an extension end extending into said pump housing intermediate the ends of said pump housing; a shaft housing extending from said pump housing intermediate the ends of said pump housing, said shaft housing positioned substantially in alignment with said impeller housing; at least one impeller shaft journalled for rotation in said shaft housing and said impeller housing and extending through said pump housing; and at least one impeller fixed to said impeller shaft, for pumping water from said one location through said impeller housing and said pump housing and through the tile pipe to said second location, responsive to rotation of said impeller shaft and said impeller.

12. The tile flood pump of claim 11 comprising an intake grid provided on said suction end of said impeller housing for screening the water flowing from said one location into said impeller housing.

13. The tile flood pump of claim 11 comprising a flange provided on said connecting end of said pump housing for engaging the pipe and removably connecting said pump housing to the pipe.

14. The tile flood pump of claim 11 comprising:

(a) an intake grid provided on said suction end of said impeller housing for screening the water flowing from said one location into said impeller housing; and (b) a flange provided on said connecting end of said pump housing for engaging the pipe and removably connecting said pump housing to the pipe.

15. The tile flood pump of claim 11 wherein said at least one impeller shaft comprises a drive shaft extending into said shaft housing for coupling to a power source; a top impeller shaft attached to said drive shaft, said top impeller shaft extending through said shaft housing and said pump housing into said impeller housing; and a bottom impeller shaft connected to said top impeller shaft, said bottom impeller shaft extending through said impeller housing to said suction end of said impeller discharge.

16. The tile flood pump of claim 15 comprising:

(a) an intake grid provided on said suction end of said impeller housing for screening the water flowing from said first location into said impeller housing; and (b) a flange provided on said connecting end of said pump housing for engaging the pipe and removably connecting said pump housing to the pipe.

17. The tile flood pump of claim 16 comprising a valve control mechanism connected to said flapper valve for selectively opening and closing said flapper valve.

18. A tile flood pump for coupling to a tile pipe having a tile pipe flange and pumping water from one location through the pipe to a second location, said tile flood pump comprising a pump housing having an intake end and a connecting end adapted for coupling to the tile pipe flange of the tile pipe; a pump housing flapper valve provided in said intake end of said pump housing for controlling a flow of water through said pump housing and the tile pipe; a rod pivotally connected to said flapper valve for opening and closing said flapper valve; an impeller housing having a suction end and an extension end extending into said pump housing at an acute angle intermediate the ends of said pump housing; a shaft housing extending from said pump housing at said acute angle intermediate said intake end and said connecting end of said pump housing, said shaft housing positioned substantially in alignment with said impeller housing; a drive shaft journalled for rotation in said shaft housing; a top impeller shaft connected to said drive shaft, said top impeller shaft extending through said impeller housing and said pump housing; a bottom impeller shaft connected to said top impeller shaft, said bottom impeller shaft extending through said pump housing and terminating at said suction end of said impeller housing; and at least one impeller fixed to said bottom impeller shaft for pumping water from said one location through said impeller housing and said pump housing and through the tile pipe to the second location, responsive to rotation of said impeller shaft and said impeller.

19. The tile flood pump of claim 18 comprising an opening provided in said impeller housing for monitoring the flow of water through said pump housing.

20. The tile flood pump of claim 19 comprising:

(a) an intake grid provided on said suction end of said impeller housing for screening the water flowing from said one location into said impeller housing; and (b) a flange provided on said connecting end of said pump housing for engaging the pipe and removably connecting said pump housing to the pipe.

* * * * *